US006010838A

United States Patent [19]

Weimann et al.

[11] Patent Number: 6,010,838

[45] Date of Patent: Jan. 4, 2000

[54] COLOR PHOTOGRAPHIC SILVER HALIDE MATERIAL

[75] Inventors: Ralf Weimann, Leverkusen; Michael Missfeldt, Leichlingen; Markus Geiger, Langenfeld, all of Germany

[73] Assignee: Agfa-Gevaert NV, Belgium

[21] Appl. No.: 09/167,476

[22] Filed: Oct. 7, 1998

[30] Foreign Application Priority Data

Oct. 17, 1997 [DE] Germany ..... 197 45 886

[51] Int. Cl.[7] ..... G03C 1/08; G03C 7/26; G03C 7/32

[52] U.S. Cl. ..... 430/557; 430/583; 430/584; 430/585; 430/588; 430/590

[58] Field of Search ..... 430/583, 584, 430/585, 588, 590, 557, 556

[56] References Cited

U.S. PATENT DOCUMENTS

| | | | |
|---|---|---|---|
| 3,044,875 | 4/1962 | Gotze et al. | 96/105 |
| 5,582,960 | 12/1996 | Nielsen et al. | 430/583 |
| 5,919,613 | 7/1999 | Missfeldt | 430/583 |
| 5,922,526 | 7/1999 | Missfeldt | 430/583 |

FOREIGN PATENT DOCUMENTS

| | | |
|---|---|---|
| 599 383 | 11/1993 | European Pat. Off. . |
| 599 384 | 11/1993 | European Pat. Off. . |
| 683 427 | 5/1995 | European Pat. Off. . |
| 709 726 | 10/1995 | European Pat. Off. . |
| 1 053 309 | 3/1959 | Germany . |
| 1 063 028 | 3/1959 | Germany . |
| 60-179744 | 2/1984 | Japan . |

*Primary Examiner*—Geraldine Letscher
*Attorney, Agent, or Firm*—Connolly, Bove, Lodge & Hutz, LLP

[57] ABSTRACT

A color photographic silver halide material, at least 95 mol. % of the silver halides of which consist of silver chloride, the blue-sensitive layer of which is spectrally sensitised with a dye of the formula I, (I)

X in which $R_1$ means 2-thienyl or 3-thienyl and

Z means —O— or —S— and $R_2$, $R_3$, $R_4$, $R_5$ and X have the meaning stated in the description, and which contains a yellow coupler of the formula II (II)

in which $R_1$, $R_2$, $R_3$, $R_4$, $R_5$, $Z_1$, $Z_2$ and m have the meaning stated in the description, is distinguished by elevated sensitivity, low yellow fog and low secondary absorption of the yellow dye.

6 Claims, No Drawings

COLOR PHOTOGRAPHIC SILVER HALIDE MATERIAL

This invention relates to a colour photographic recording material having at least one blue-sensitised silver halide layer, with which a yellow coupler is associated, and in which at least 95 mol. % of the silver halide consists of silver chloride, which material is distinguished after chromogenic development by a yellow image dye having only relatively low secondary absorption, elevated sensitivity and low yellow fog.

It is known to produce colour photographic images by chromogenic development.

It is also known that the absorption characteristics of the dye produced by chromogenic development are substantially responsible for the visual appearance of the image. Yellow dyes which have excessive absorption in the green range of the spectrum thus exhibit a distinct red cast.

It is furthermore known that yellow couplers as are described in U.S. Pat. Nos. 5,451,492 and EP 0 568 196 form yellow dyes on chromogenic development which exhibit only slight absorption in the green range of the spectrum, i.e. they reproduce yellow hues without a reddish cast. The poor coupling activity of these couplers is, however, disadvantageous. While this disadvantage may indeed partially be offset by increasing the application rate of coupler or of silver halide, the associated increase in layer thickness brings about other problems. Especially in rapid processing systems, an excessive layer thickness is unfavourable, resulting in inadequate bleaching of the silver and elevated yellow fog. Sensitisers are known from DE 1 053 309, U.S. Pat. No. 3,044,875 and DE 10 63 028, the feature of which is a thienyl substituent on the chromophoric system. However, in the patents, these sensitisers were only investigated with silver bromide emulsions. EP 0 599 383 describes a sensitiser having a thienyl substituent as a comparison sensitiser in a silver bromide emulsion, but elevated yellow fog is found to be disadvantageous. Thienyl-substituted sensitisers are also mentioned in EP 0 599 384, JP-N 60-179744 and EP 683 427, but no photographic advantages are mentioned. EP 0 709 726 describes test results of a thienylbenzothiazole type sensitiser with a silver chloride emulsion with a-(4-benzyloxyphenylsulfonyl) phenoxy)-a-pivaloyl-2-chloro-5-(g-(2,4-di-5-amylphenoxy)-butyramido)acetanilide being used as the coupler. This combination of yellow coupler and sensitiser exhibits a distinct loss in sensitivity relative to the Comparative Example.

The object underlying the invention is to provide a colour photographic recording material which contains silver halide emulsion layers, in which at least 95 mol. % of the silver halide consists of silver chloride, with associated cyan, magenta and yellow couplers and which, by using a suitable blue sensitiser during chromogenic development, yields a yellow image dye having only very slight secondary absorption combined with very good sensitivity and low fog.

This object could surprisingly be achieved by combining specific yellow couplers with specific sensitisers.

The present invention provides a colour photographic recording material having a film support and, arranged thereon, at least one red-sensitive silver halide emulsion layer, with which a cyan coupler is associated, at least one green-sensitive silver halide emulsion layer, with which a magenta coupler is associated, at least one blue-sensitive silver halide emulsion layer, with which a yellow coupler is associated, and optionally further layers, characterised in that the blue-sensitive layer is spectrally sensitised with a dye of the formula (I)

(I)

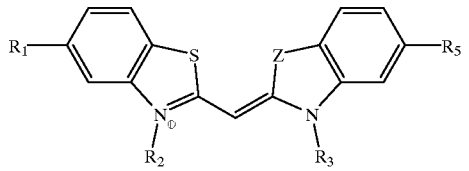

X in which $R_1$ means 2-thienyl or 3-thienyl;

$R_2$ and $R_3$ mutually independently mean alkyl, sulfoalkyl, carboxyalkyl, —$(CH_2)_n$—$SO_2$—NH—$SO_2$-alkyl; —$(CH_2)_n$—$SO_2$—NH—CO-alkyl; —$(CH_2)_n$—CO—NH—$SO_2$-alkyl; —$(CH_2)_n$—CO—NH—CO-alkyl;

$R_4$ and $R_5$ mutually independently mean H, halogen, alkyl, methoxy, aryl, 2-furanyl, 3-furanyl, 2-thienyl, 3-thienyl, 1-pyrrolyl, 2-pyrrolyl, 3-pyrrolyl, 1-indolyl, N-carbazolyl or 2-isoindolyl, or $R_4$ with $R_5$ mean the residue necessary for completing an optionally substituted, fused benzo or naphtho ring Z means —O— or —S—;

n means 1 to 6 and

X means a counterion optionally present to equalise charges and a yellow coupler of the formula II (II)

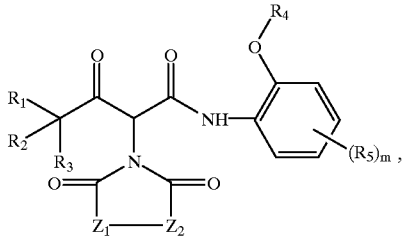

in which $R_1$, $R_2$, $R_3$ mutually independently mean alkyl or $R_2$ and $R_3$ together form a three- to six-membered ring;

$R_4$ means alkyl, cycloalkyl or aryl;

$R_5$ means halogen; alkyl; alkoxy; aryloxy; alkoxycarbonyl; alkylsulfonyl; alkylcarbamoyl; arylcarbamoyl; alkylsulfamoyl; arylsulfamoyl; alkylcarbonamido; alkylsulfonamido; arylsulfonamido;

m means 0, 1, 2, 3;

$Z_1$ means —O—, —$NR_6$—;

$Z_2$ means —$NR_7$— or —$C(R_8)R_9$—;

$R_6$, $R_7$, $R_8$ and $R_9$ mutually independently mean hydrogen or a substituent.

The substituents on the formula II preferably have the following meanings:

$R_5$ alkoxycarbonyl, alkylcarbamoyl, alkylsulfamoyl, alkylcarbonamido, alkylsulfonamido, $R_6$ H, alkyl, phenyl, benzyl $R_7$, $R_8$, $R_9$ H, alkyl, alkoxy.

The substituents on the formula I preferably have the following meanings:

$R_4$ hydrogen $R_5$ chlorine, fluorine, 2-thienyl, 1-pyrrolyl, 1-indolyl or, together with $R_4$, the remaining members of a benzo or naphtho ring system.

Examples of sensitisers according to the invention of the formula (I) are:

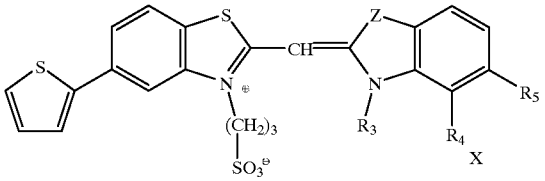

| | Z | $R_3$ | $R_4$ | $R_5$ | X |
|---|---|---|---|---|---|
| I-1 | S | 3-sulfopropyl | H | Cl | $(C_2H_5)_3NH^{\oplus}$ |
| I-2 | S | 3-sutfopropyl | H | F | $(C_2H_5)_3NH^{\oplus}$ |
| I-3 | S | 3-sulfopropyl | H | $CH_3$ | $(C_2H_5)_3NH^{\oplus}$ |
| I-4 | S | 3-sulfopropyl | 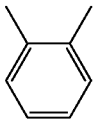 | | $(C_2H_5)_3NH^{\oplus}$ |
| I-5 | S | 3-sulfopropyl | 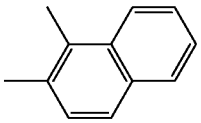 | | $(C_2H_5)_3NH^{\oplus}$ |
| I-6 | S | 3-sulfopropyl | H | 2-thienyl | $(C_2H_5)_3NH^{\oplus}$ |
| I-7 | S | 2-carboxyethyl | H | 3-thienyl | — |
| I-8 | S | 3-sulfopropyl | H | 1-pyrrolyl | $Na^{\oplus}$ |
| I-9 | S | 3-sulfopropyl | H | 1-indolyl | $Li^{\oplus}$ |
| I-10 | S | 3-sulfopropyl | H | 1-carbazolyl | $(C_2H_5)_3NH^{\oplus}$ |
| I-11 | S | 3-sulfopropyl | H | 2-furanyl | $Li^{\oplus}$ |
| I-12 | O | 3-sulfopropyl | 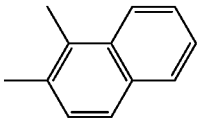 | | $(C_2H_5)_3NH^{\oplus}$ |

-continued

| | Z | $R_3$ | $R_4$ | $R_5$ | X |
|---|---|---|---|---|---|
| I-13 | O | 3-sulfopropyl | 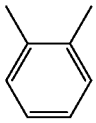 | | $(C_2H_5)_3NH^{\oplus}$ |
| I-14 | S | 3-sulfopropyl | H | Br | $(C_2H_5)_3NH^{\oplus}$ |
| I-15 | S | 3-sulfopropyl | H | phenyl | $(C_2H_5)_3NH^{\oplus}$ |

I-16

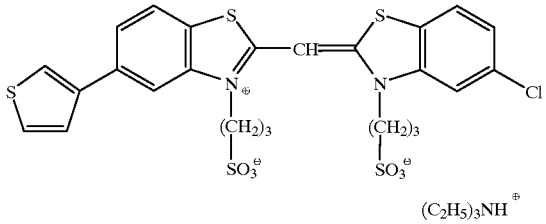

$(C_2H_5)_3NH^{\oplus}$

I-17

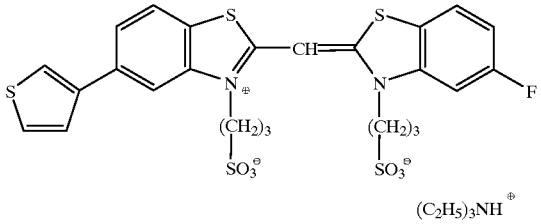

$(C_2H_5)_3NH^{\oplus}$

I-18

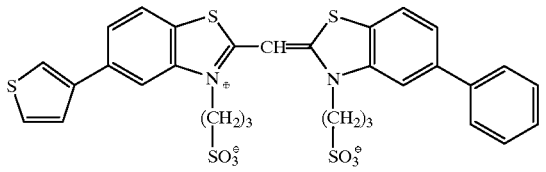

$(C_2H_5)_3NH^{\oplus}$

Examples of yellow couplers according to the invention of the formula II are:

Y-1

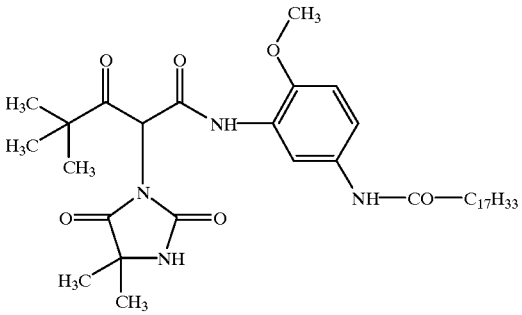

-continued
Y-2
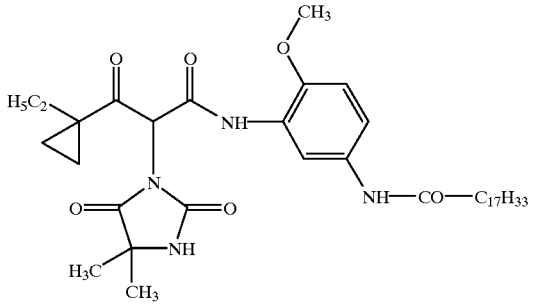
Y-3
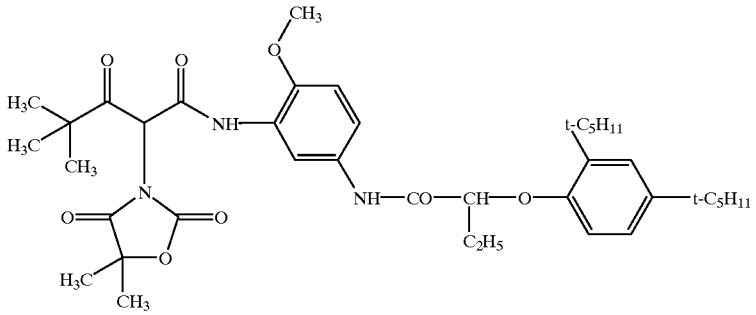
Y-4
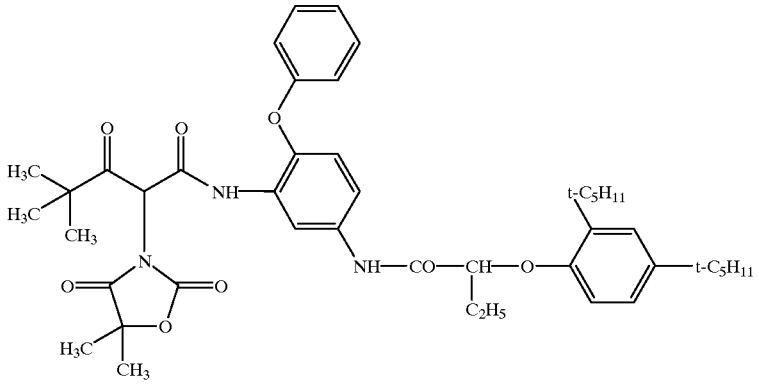
Y-5
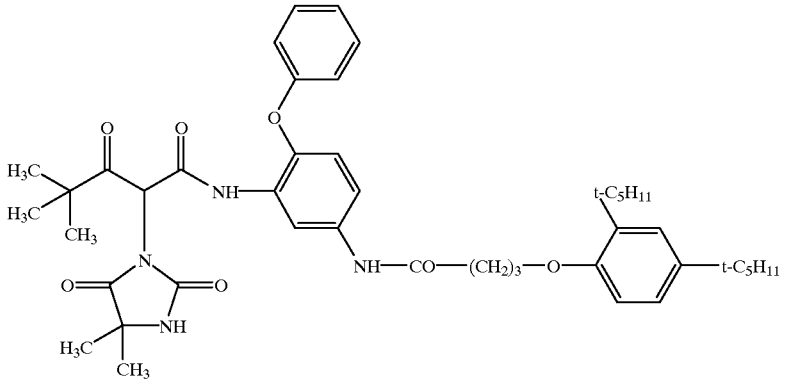

-continued
Y-6
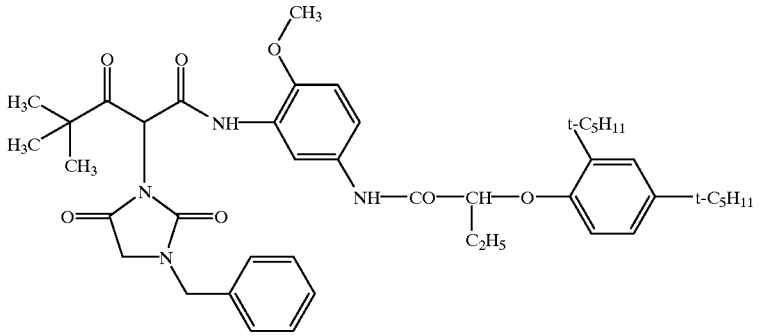
Y-7
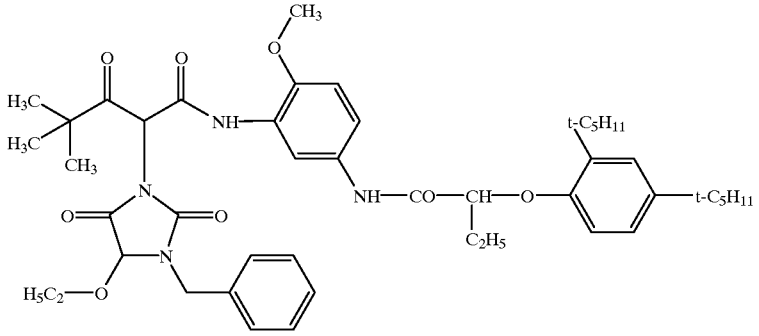
Y-8
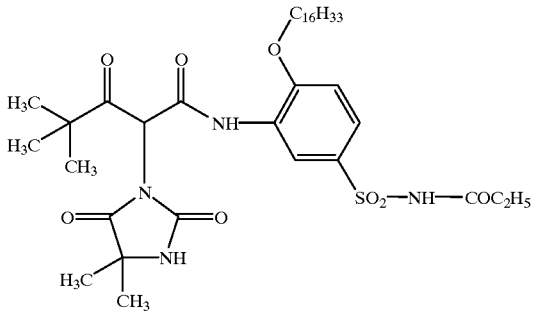
Y-9
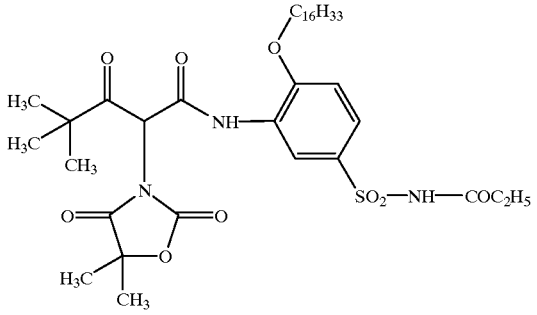

-continued
Y-10
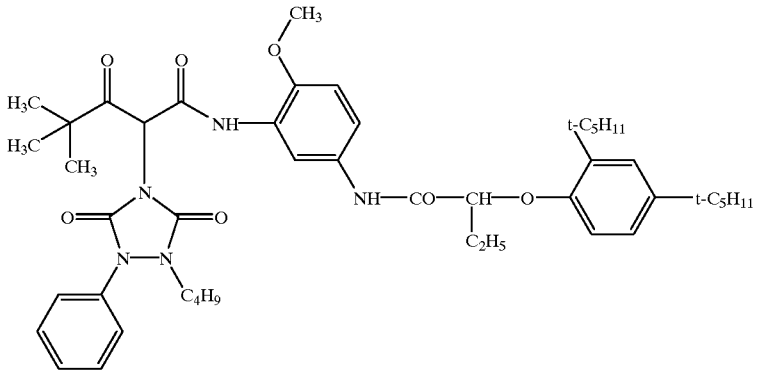
Y-11
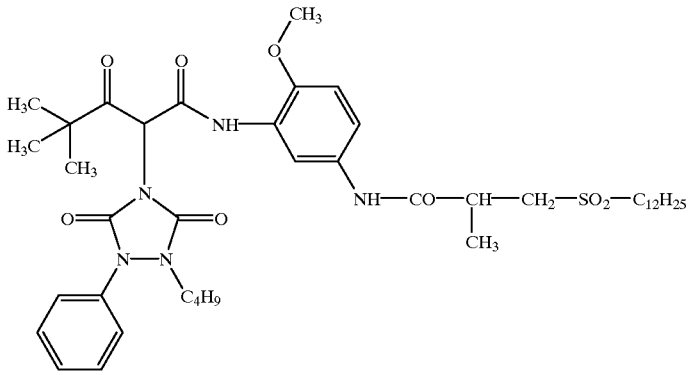
Y-12
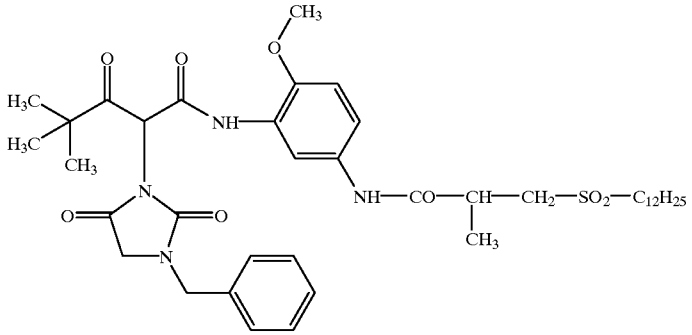
Y-13
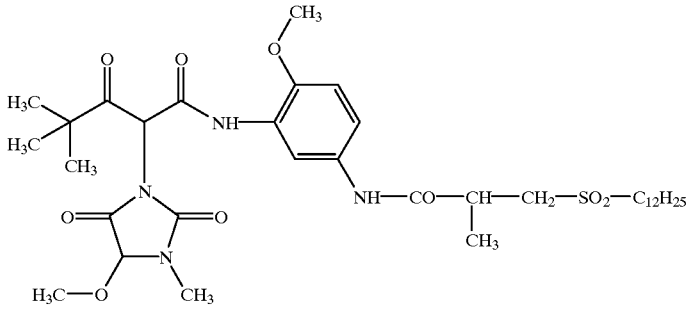

-continued
Y-14
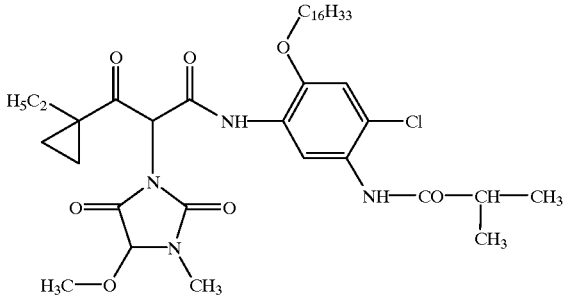
Y-15
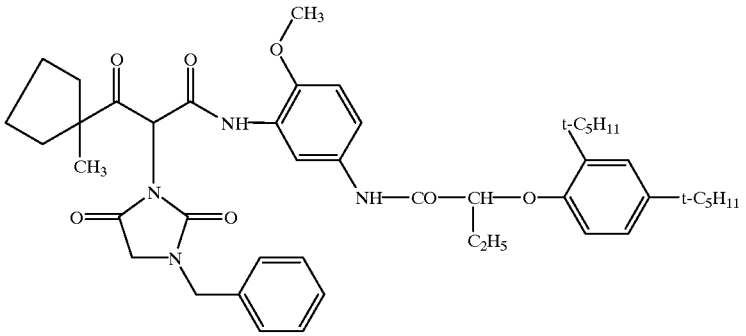
Y-16
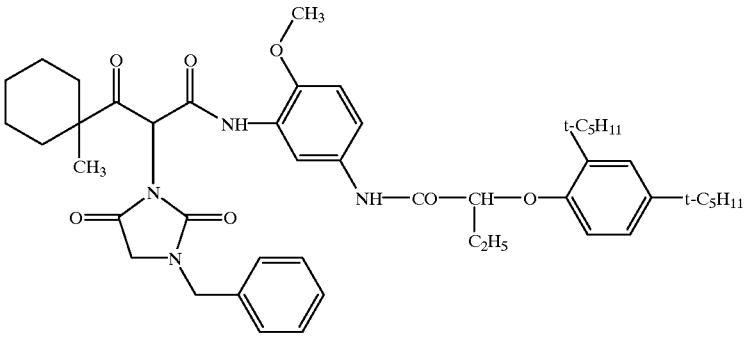
Y-17
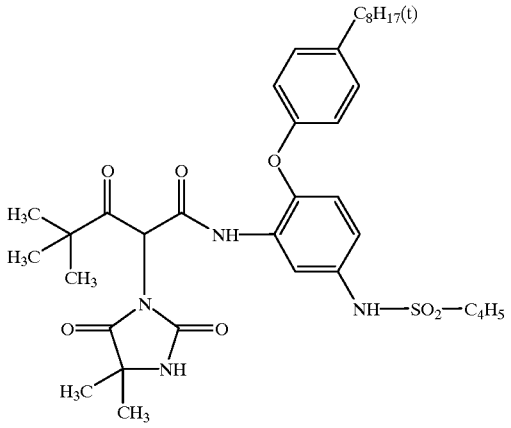

-continued
Y-18
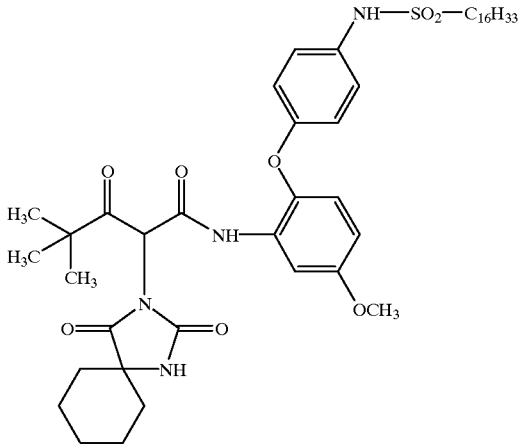
Y-19
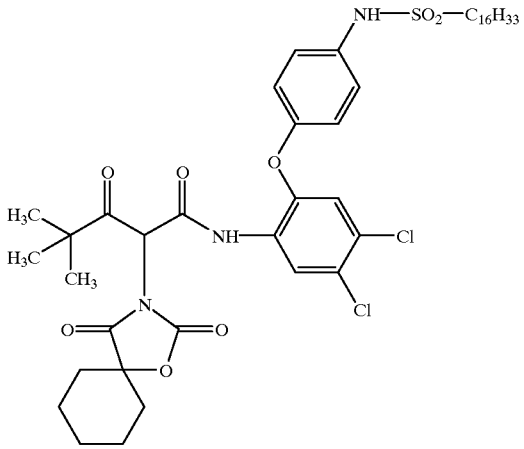
Y-20
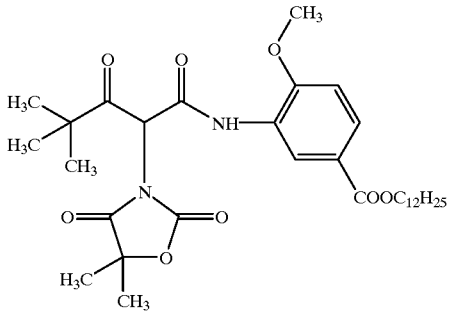
Y-21
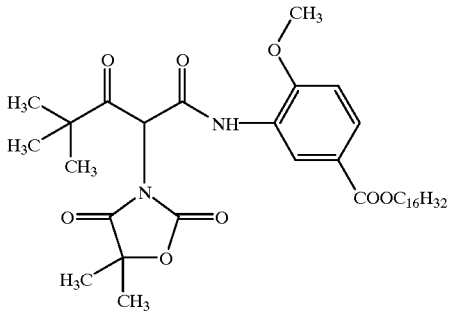

-continued
Y-22
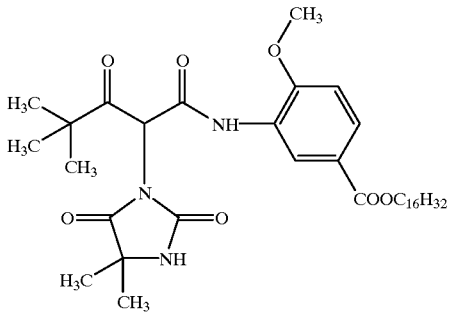
Y-23
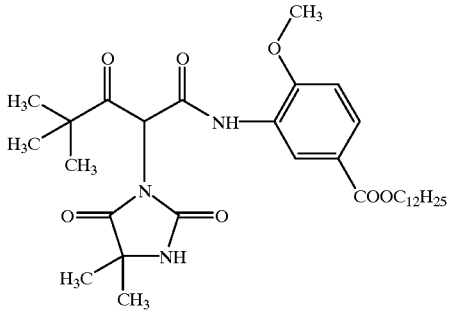
Y-24
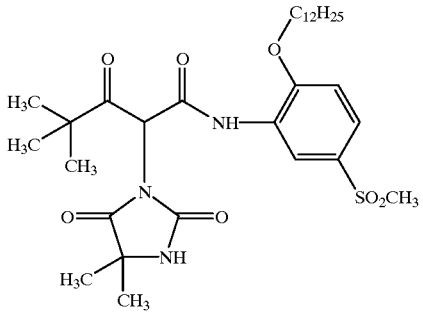
Y-25
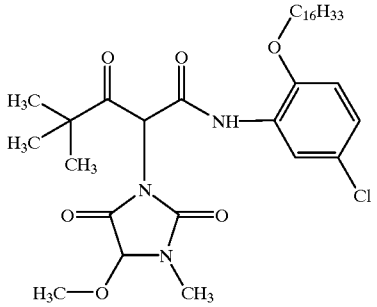
Y-26
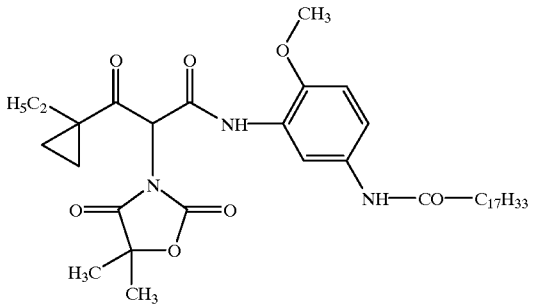

-continued
Y-27
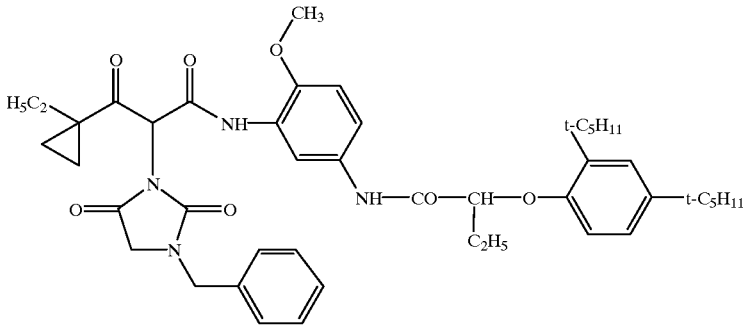
Y-28
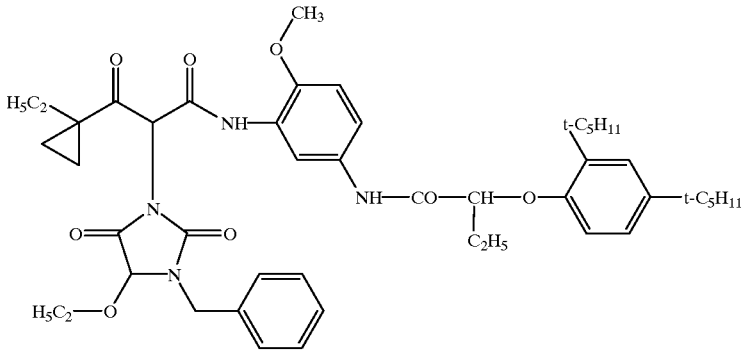
Y-29
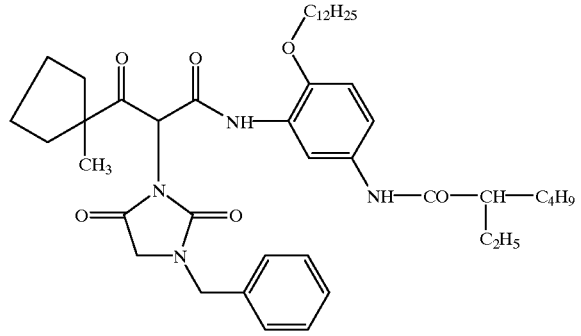
Y-30
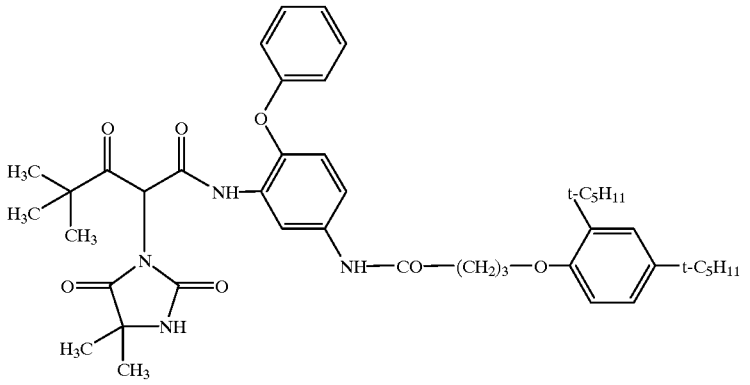

-continued
Y-31
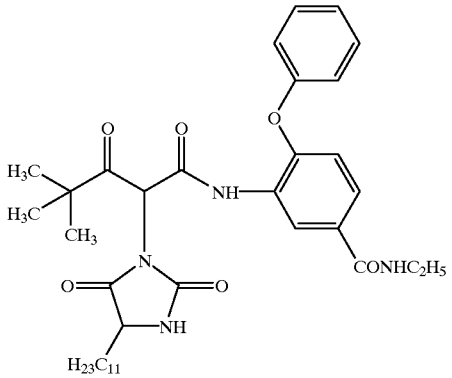
Y-32
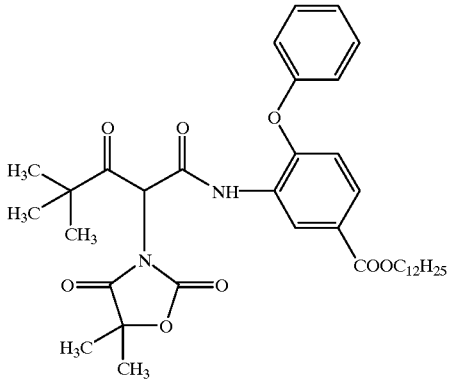
Y-33
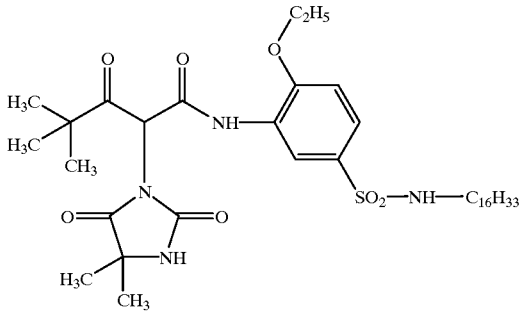
Y-34
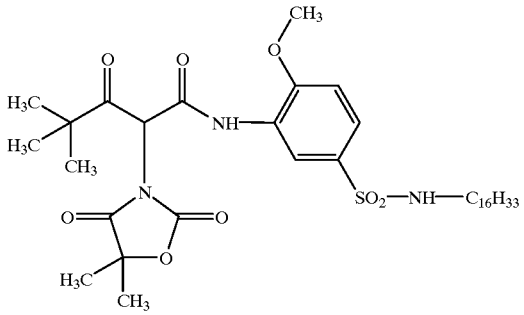

-continued
Y-35
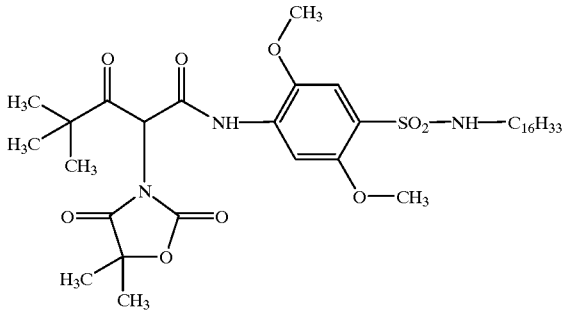
Y-36
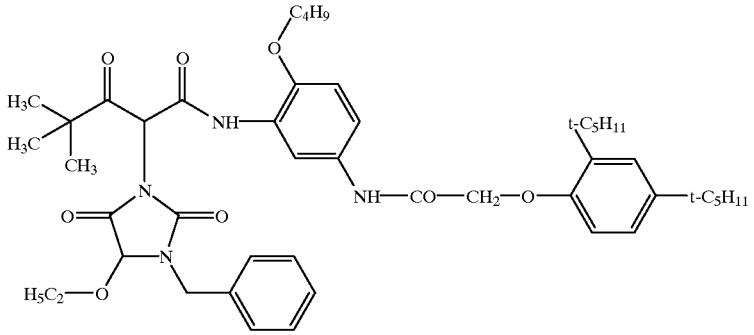
Y-37
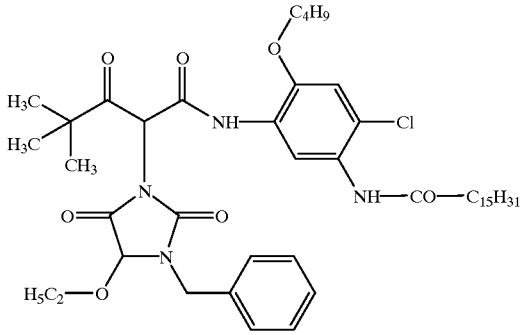
Y-38
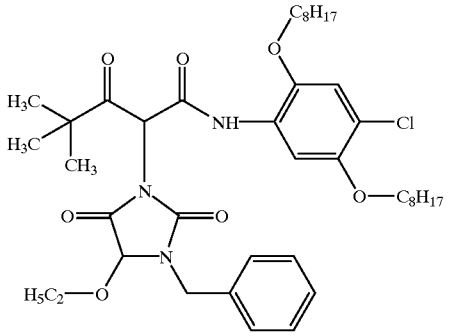

-continued
Y-39
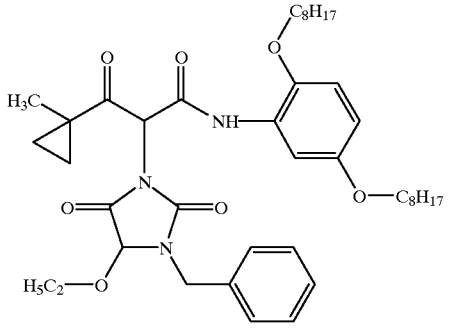
Y-40
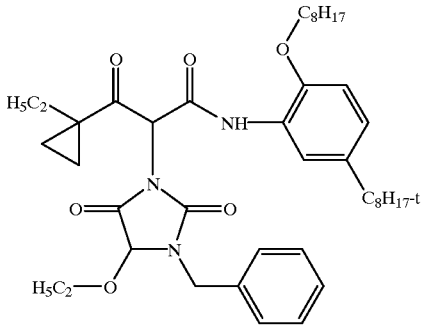
Y-41
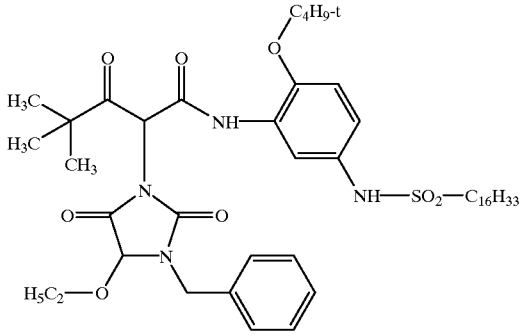
Y-42
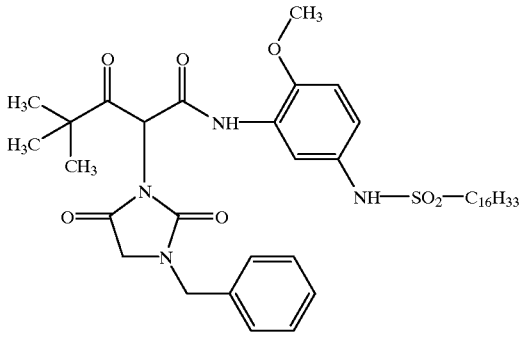

-continued
Y-43
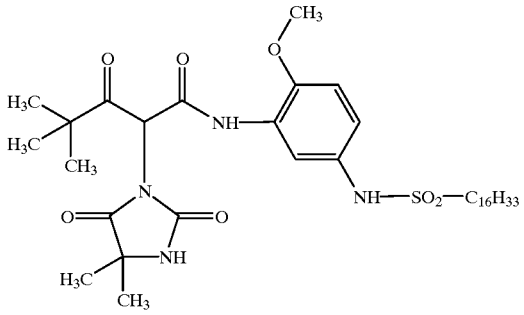
Y-44
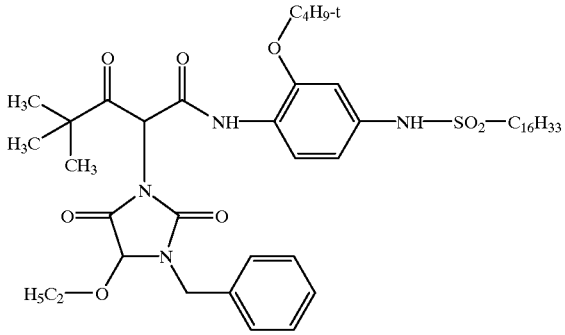
Y-45
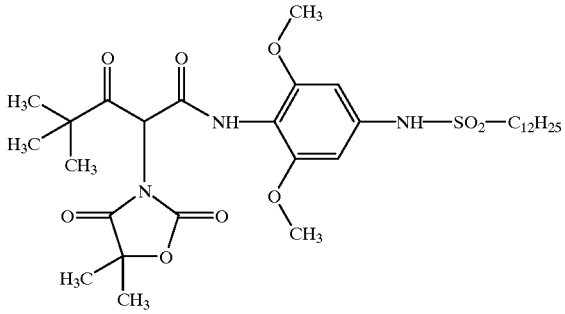
Y-46
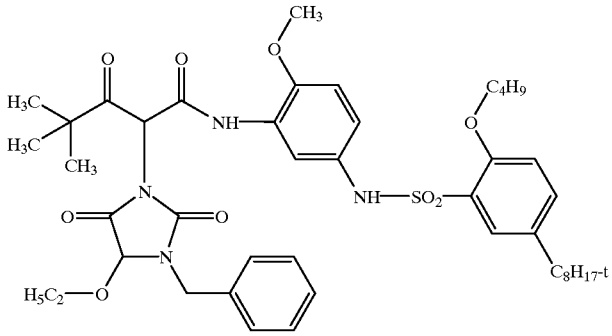

-continued

Y-47

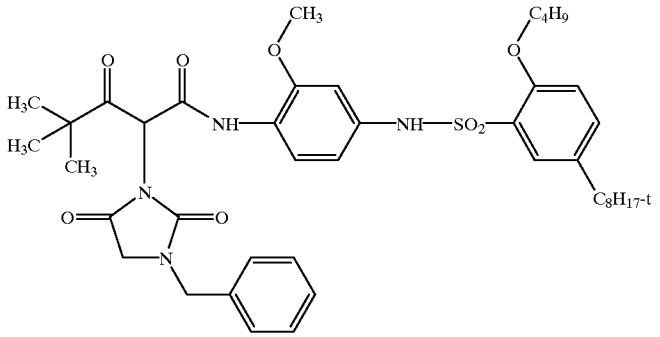

Y-48

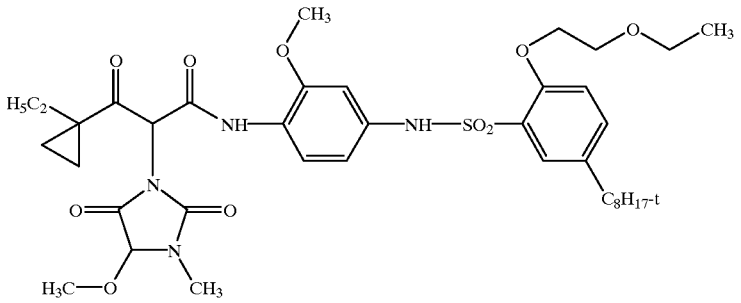

Y-49

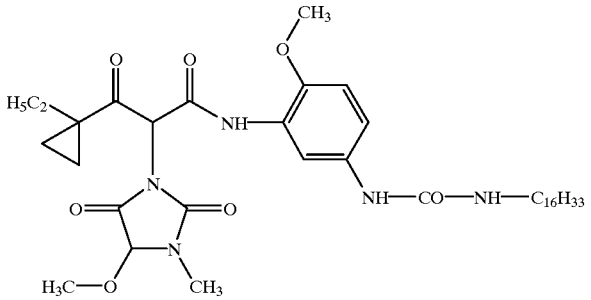

Y-50

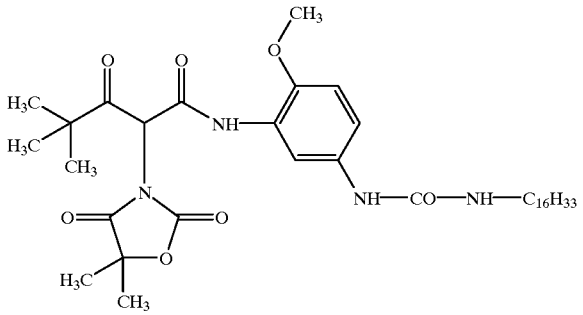

Colour photographic paper (print material) is in particular considered as the colour photographic material.

The photographic materials consist of a support, onto which is applied at least one photosensitive silver halide emulsion layer. Thin films and sheets are in particular suitable as supports. A review of support materials and the auxiliary layers applied to the front and reverse sides of which is given in *Research Disclosure* 37254, part 1(1995), page 285 and in *Research Disclosure* 38957, part XV (1996), page 627.

The substantial constituents of the photographic emulsion layers are the binder, silver halide grains and colour couplers.

Details of suitable binders may be found in *Research Disclosure* 37254, part 2 (1995), page 286 and in *Research Disclosure* 38957, part IIA (1996), page 598.

Details of suitable silver halide emulsions, the production, ripening, stabilisation and spectral sensitisation thereof, including suitable spectral sensitisers, are given in *Research Disclosure* 37254, part 3 (1995), page 286, in *Research Disclosure* 37038, part XV (1995), page 89 and in *Research Disclosure* 38957, part VA (1996), page 603.

Details relating to colour couplers may be found in *Research Disclosure* 37254, part 4 (1995), page 288, in *Research Disclosure* 37038, part II (1995), page 80 and in *Research Disclosure* 38957, part XB (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part XD (1996), page 621.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (lattices), biocides and others.

Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part IIB (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

EXAMPLES

Example 1

A colour photographic recording material was produced by applying the following layers in the stated sequence onto a film support of paper coated on both sides with polyethylene. Quantities are stated per 1 $m^2$. The silver halide application rate is stated as the corresponding quantities of $AgNO_3$.

Layer Structure 1

Layer 1: (Substrate layer)

0.10 g of gelatine

Layer 2: (Blue-sensitive layer)

Blue-sensitive silver halide emulsion (99.5 mol. % chloride, 0.5 mol. % bromide, average grain diameter 0.8 $\mu$m) prepared from 0.40 g of $AgNO_3$ with 1.25 g of gelatine 0.50 g of yellow coupler CY-1

0.30 g of tricresyl phosphate (TCP)

0.10 g of stabiliser ST-1

0.70 mg of blue sensitiser BS-1

0.30 mg of stabiliser ST-2

Layer 3: (Interlayer)

1.10 g of gelatine 0.06 g of DOP scavenger SC-1

0.06 g of DOP scavenger SC-2

0.12 g of TCP

Layer 4: (Green-sensitive layer)

Green-sensitive silver halide emulsion (99.5 mol. % chloride, 0.5 mol. % bromide, average grain diameter 0.45 $\mu$m) prepared from 0.2 g of $AgNO_3$ with 1.10 g of gelatine 0.05 g of magenta coupler M-1

0.05 g of magenta coupler M-2

0.05 g of magenta coupler M-3

0.50 mg of stabiliser ST-4

0.15 g of stabiliser ST-6

0.15 g of stabiliser ST-3

0.40 g of TCP 0.70 g of green sensitiser GS-1

Layer 5: (Interlayer)

1.05 g of gelatine 0.40 g of UV absorber UV-1

0.10 g of UV absorber UV-2

0.05 g of UV absorber UV-3

0.05 g of UV absorber UV-4

0.10 g of anti-oxidant OS-1

0.05 g of anti-oxidant OS-2

0.05 g of anti-oxidant OS-3

0.10 g of coupler solvent KL-1

0.10 g of coupler solvent KL-2

0.05 g of coupler solvent KL-3

0.06 g of DOP scavenger SC-1

0.06 g of DOP scavenger SC-2

0.12 g of TCP

Layer 6: (Red-sensitive layer)

Red-sensitive silver halide emulsion (99.5 mol. % chloride, 0.5 mol. % bromide, average grain diameter 0.48 $\mu$m) prepared from 0.28 g of $AgNO_3$ with 1.0 g of gelatine 0.35 g of cyan coupler C-1

0.05 g of cyan coupler C-2

0.80 g of TCP 0.20 g of UV absorber UV-1

0.03 mg of red sensitiser RS-3

0.60 mg of stabiliser ST-5

0.10 g of coupler solvent KL-4

0.05 g of coupler solvent KL-2

Layer 7: (UV protective layer)

0.35 g of gelatine 0.50 g of UV absorber UV-1

0.03 g of UV absorber UV-2
0.09 g of TCP
Layer 8: (Protective layer)
0.90 g of gelatine
0.05 g of optical brightener WT-1
0.07 g of mordant (polyvinylpyrrolidone)
1.20 mg of silicone oil
2.50 mg of spacers (polymethyl methacrylate, average grain size 0.8 $\mu$m)
0.30 g of hardener H-1
Compounds used in the Example:
CY-1
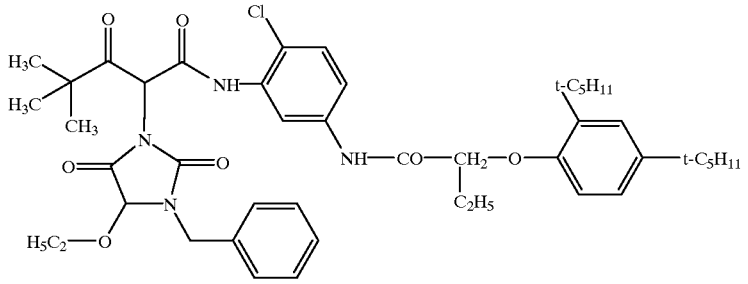
M-1
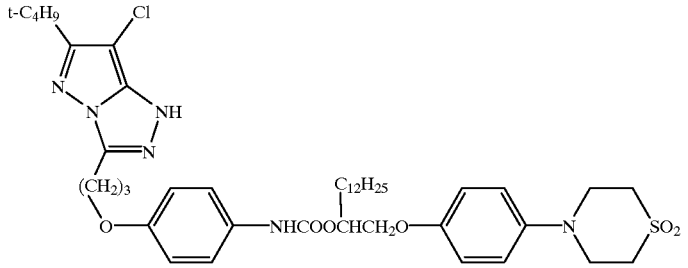
M-2
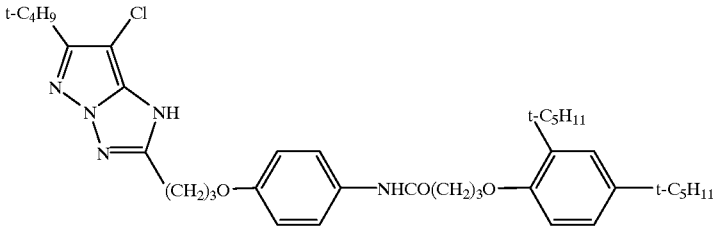
M-3
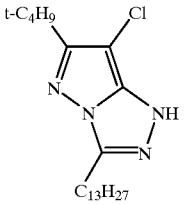
C-1
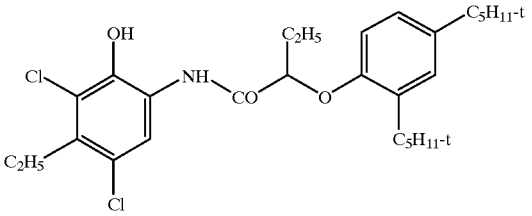
C-2
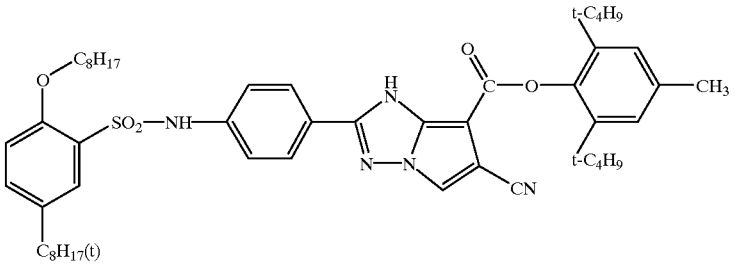

-continued
BS-1
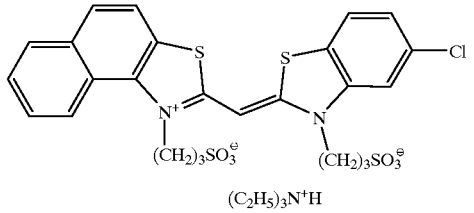
GS-1
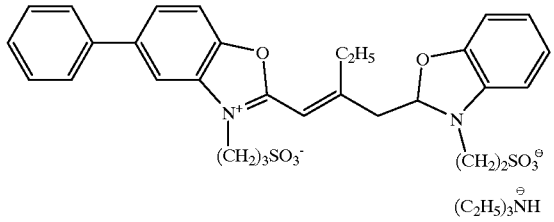
RS-1
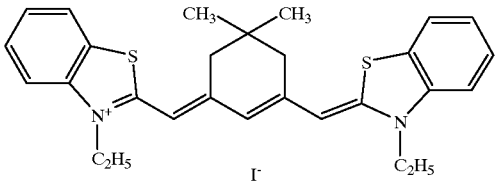
ST-1
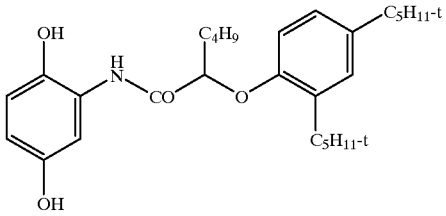
ST-2
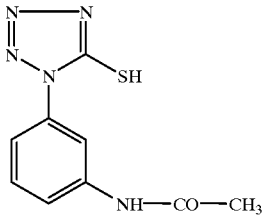
ST-3
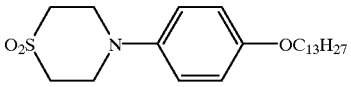
ST-4
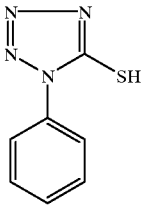
ST-5
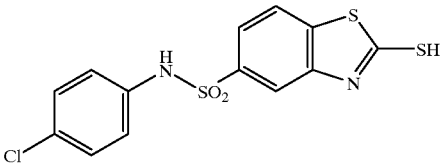

-continued
ST-6
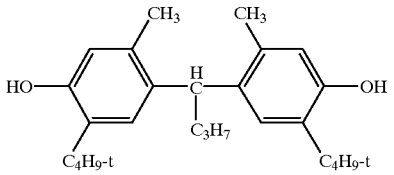
SC-1
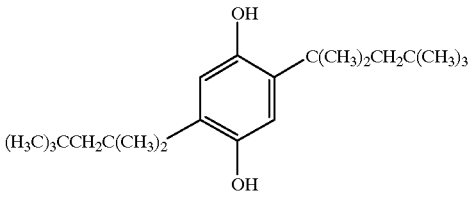
SC-2
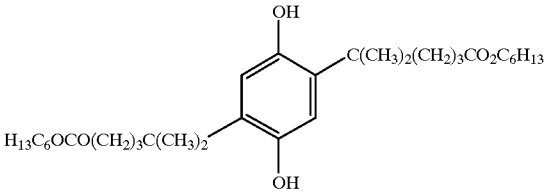
UV-1
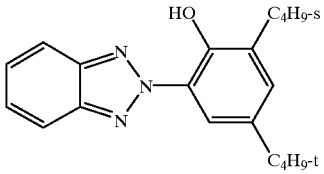
UV-2
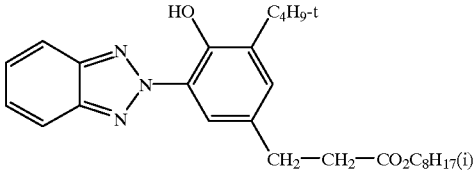
UV-3
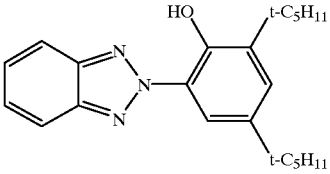
UV-4
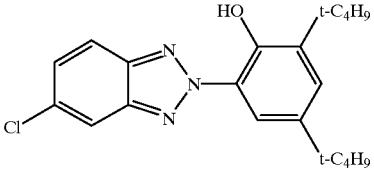
OS-1
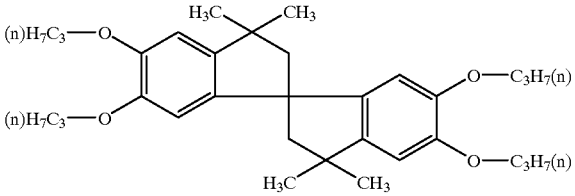
OS-2
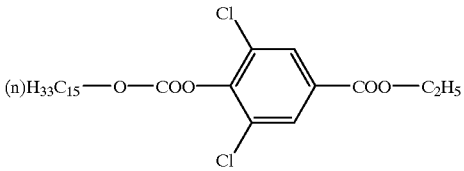
OS-3
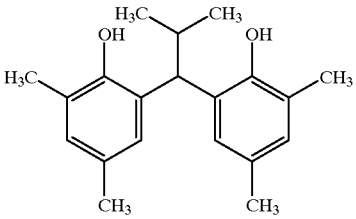
KL-1
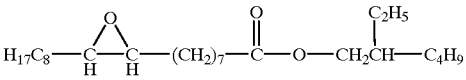
KL-2
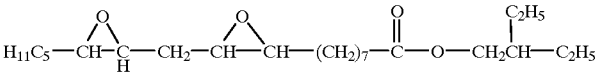
KL-3
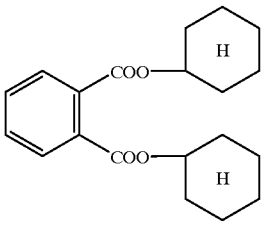
KL-4
Tri(isopropylphenyl) phosphate -continued

WT-1

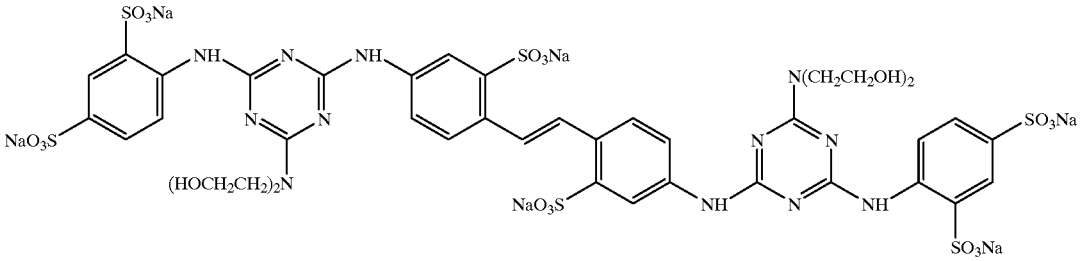

H-1

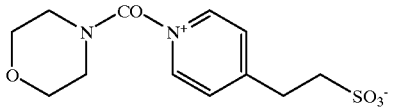

Layer Structures 2 to 23

In layer structures 2 to 23, yellow coupler CY-1 and sensitiser BS-1 in layer 2 were replaced by the compounds stated in Table 1.

All the specimens were exposed through a step wedge and a U 449 colour separation filter and processed as follows:

| | |
|---|---|
| a) Colour developer - 45 s - 35° C. | |
| Diethylene glycol | 0.05 g |
| Triethanolamine | 9.0 g |
| N,N-diethylhydroxylamine | 4.0 g |
| N-ethyl-N-(2-methanesulfonamidoethyl)-4-amino-3-methylbenzene sulfate | 5.0 g |
| Potassium sulfite | 0.2 g |
| Potassium carbonate | 22.0 g |
| Triethylene glycol | 0.05 g |
| Potassium hydroxide | 0.4 g |
| Ethylenediaminetetraacetic acid, disodium salt | 2.2 g |
| Potassium chloride | 2.5 g |
| 1,2-Dihydroxybenzene-3,4,6-trisulfonic acid, trisodium salt | 0.3 g |
| make up to 1000 ml with water; adjust pH value to pH 10.0 with KOH or $H_2SO_4$. | |
| b) Bleach/fixing bath - 45 s - 35° C. | |
| Ammonium thiosulfate | 75.0 g |
| Sodium hydrogen sulfite | 13.5 g |
| Ethylenediaminetetraacetic acid (iron/ammonium salt) | 57.0 g |
| make up to 1000 ml with water; adjust pH value to pH 6.0 with ammonia (25 wt. %) or acetic acid. | |
| c) Rinsing - 2 min - 33° C. | |
| d) Drying | |

Further comparison compounds:

CY-2

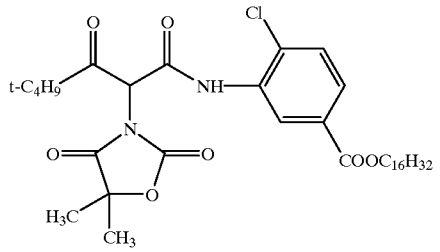

-continued

CY-3

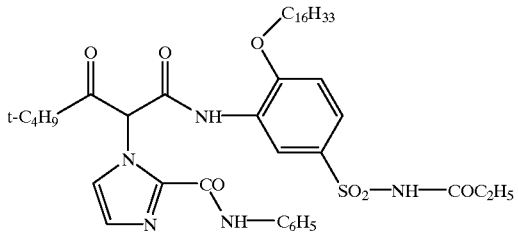

BS-2

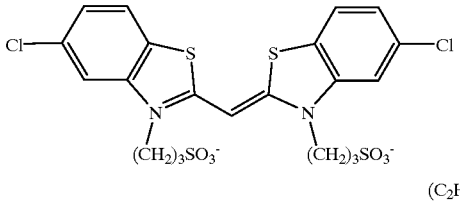

BS-3

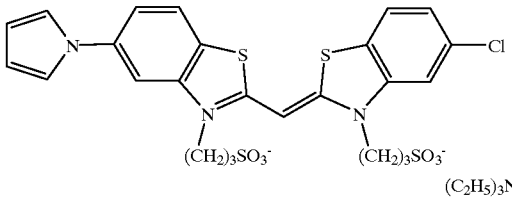

The relative sensitivity, fog, maximum density and magenta secondary density at maximum density were determined from the specimens.

| Specimen | Yellow coupler | Blue sensitiser | | Relative sensitivity | $D_{min}$ | $D_{max}$ | Magenta secondary density at D % |
|---|---|---|---|---|---|---|---|
| 1 | CY-1 | BS-1 | Comparison | 100 | 0.12 | 2.35 | 16.2 |
| 2 | CY-1 | I-1 | Comparison | 109 | 0.13 | 2.40 | 16.0 |
| 3 | CY-1 | BS-2 | Comparison | 98 | 0.12 | 2.29 | 15.9 |
| 4 | CY-2 | BS-2 | Comparison | 98 | 0.13 | 2.31 | 15.7 |
| 5 | CY-2 | I-1 | Comparison | 108 | 0.12 | 2.39 | 15.9 |
| 6 | CY-3 | BS-3 | Comparison | 98 | 0.12 | 2.19 | 16.4 |
| 7 | CY-3 | I-1 | Comparison | 108 | 0.13 | 2.41 | 16.3 |
| 8 | Y-1 | BS-1 | Comparison | 99 | 0.12 | 2.35 | 14.5 |
| 9 | Y-11 | BS-2 | Comparison | 97 | 0.12 | 2.22 | 13.9 |
| 10 | Y-1 | I-1 | Invention | 108 | 0.10 | 2.32 | 14.4 |
| 11 | Y-1 | I-16 | Invention | 106 | 0.10 | 2.27 | 14.3 |
| 12 | Y-1 | I-4 | Invention | 109 | 0.11 | 2.39 | 14.6 |
| 13 | Y-1 | I-11 | Invention | 105 | 0.10 | 2.25 | 14.4 |
| 14 | Y-3 | I-1 | Invention | 109 | 0.09 | 2.37 | 14.0 |
| 15 | Y-3 | I-6 | Invention | 106 | 0.10 | 2.41 | 14.1 |
| 16 | Y-11 | I-7 | Invention | 105 | 0.09 | 2.29 | 13.7 |
| 17 | Y-11 | I-8 | Invention | 106 | 0.09 | 2.38 | 13.9 |
| 18 | Y-11 | BS-1 | Comparison | 99 | 0.12 | 2.29 | 14.0 |
| 19 | Y-12 | BS-2 | Comparison | 99 | 0.13 | 2.31 | 13.9 |
| 20 | Y-17 | BS-3 | Comparison | 97 | 0.12 | 2.27 | 13.8 |
| 21 | Y-17 | I-2 | Invention | 106 | 0.11 | 2.35 | 14.0 |
| 22 | Y-21 | I-1 | Ivention | 109 | 0.10 | 2.33 | 14.4 |
| 23 | Y-22 | I-1 | Invention | 108 | 0.11 | 2.40 | 14.2 |

As evident from Table 1, the combination according to the invention of yellow coupler and blue sensitiser improves the absorption characteristics of the yellow image dyes while simultaneously increasing blue sensitivity and reducing yellow fog.

We claim:

1. A color photographic recording material which comprises a film support and, arranged thereon, at least one red-sensitive silver halide emulsion layer, with which a cyan coupler is associated, at least one green-sensitive silver halide emulsion layer, with which a magenta coupler is associated, at least one blue-sensitive silver halide emulsion layer, with which a yellow coupler is associated, and optionally further layers, and said blue-sensitive layer is spectrally sensitized with a dye of the formula (I)

(I)

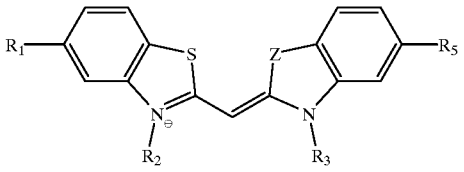

X in which $R_1$ is 2-thienyl or 3-thienyl;

$R_2$ and $R_3$ mutually independently are alkyl, sulfoalkyl, carboxyalkyl, $—(CH_2)_n—SO_2—NH—SO_2$-alkyl; $—(CH_2)_n—SO_2—NH—CO$-alkyl; $—(CH_2)_n—CO—NH—SO_2$-alkyl; $—(CH_2)_n—CO—NH—CO$-alkyl;

$R_4$ and $R_5$ mutually independently are H, halogen, alkyl, methoxy, aryl, 2-furanyl, 3-furanyl, 2-thienyl, 3-thienyl, 1-pyrrolyl, 2-pyrrolyl, 3-pyrrolyl, 1-indolyl, N-carbazolyl or 2-isoindolyl, or $R_4$ with $R_5$ are the residue necessary for completing an optionally substituted, fused benzo or naphtho ring Z is —O— or —S—;

n is 1 to 6 and

X is a counterion optionally present to equalize charges and a yellow coupler of the formula II (II)

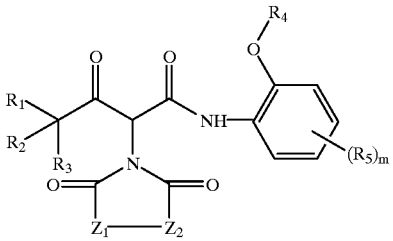

in which $R_1$, $R_2$ and $R_3$ mutually independently are alkyl or $R_2$ and $R_3$ together form a three- to six-membered ring;

$R_4$ is alkyl, cycloalkyl or aryl;

$R_5$ is halogen; alkyl; alkoxy; aryloxy; alkoxycarbonyl; alkylsulfonyl; alkylcarbamoyl; arylcarbamoyl; alkylsulfamoyl; arylsulfamoyl; alkylcarbonamido; alkylsulfonamido or arylsulfonamido;

m is 0, 1, 2 or 3;

$Z_1$ is —O— or $—NR_6—$;

$Z_2$ is $—NR_7—$ or $—C(R_8)R_9—$;

$R_6$, $R_7$, $R_8$ and $R_9$ mutually independently are hydrogen or a substituent.

2. The color photographic recording material according to claim 1, wherein in the formula I $R_4$ is a hydrogen atom and $R_5$ is a chlorine atom, fluorine atom, 2-thienyl, 1-pyrrolyl or 1-indolyl or, together with $R_4$, form a benzene ring and in the formula II $R_5$ is alkoxycarbonyl, alkylcarbamoyl, alkylsulfamoyl, alkylcarbonamido or alkylsulfonamido, $R_6$ is a hydrogen atom, alkyl, phenyl or benzyl, $R_7$, $R_8$, $R_9$ mutually independently are a hydrogen atom, alkyl or alkoxy.

3. The color photographic recording material according to claim 1, wherein in the formula I, $R_4$ together with $R_5$ form a naphtho ring.

4. The color photographic recording material according to claim 2, wherein Z is S and $R_4$ is H.

5. The color photographic recording material according to claim 4, wherein $R_3$ is 3-sulfopropyl.

6. The color photographic recording material according to claim 5, wherein X is $(C_2H_5)_3NH^{\oplus}$.

* * * * *